US010122118B1

(12) United States Patent
Bustos et al.

(10) Patent No.: US 10,122,118 B1
(45) Date of Patent: Nov. 6, 2018

(54) APPARATUS, SYSTEM, AND METHOD FOR ACHIEVING POWER CONNECTIONS IN SPACE-LIMITED COMPUTING ENVIRONMENTS

(71) Applicant: Juniper Networks, Inc., Sunnyvale, CA (US)

(72) Inventors: Fernando V. Bustos, Daly City, CA (US); Mahesh Nagarajan, Morgan Hill, CA (US); Philip Quaife, Santa Clara, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 0 days.

(21) Appl. No.: 15/615,828

(22) Filed: Jun. 6, 2017

(51) Int. Cl.

| | |
|---|---|
| ***H01R 13/11*** | (2006.01) |
| ***H01R 13/629*** | (2006.01) |
| ***H01R 13/72*** | (2006.01) |
| ***H01R 31/06*** | (2006.01) |
| ***H01R 13/60*** | (2006.01) |
| ***H01R 24/28*** | (2011.01) |
| *H01R 13/56* | (2006.01) |
| *H01R 13/58* | (2006.01) |
| *H01R 13/621* | (2006.01) |
| *H01R 13/443* | (2006.01) |

(52) U.S. Cl.
CPC ..... *H01R 13/629* (2013.01); *H01R 13/60* (2013.01); *H01R 13/72* (2013.01); *H01R 24/28* (2013.01); *H01R 31/06* (2013.01); *H01R 13/443* (2013.01); *H01R 13/567* (2013.01); *H01R 13/5833* (2013.01); *H01R 13/5841* (2013.01); *H01R 13/6215* (2013.01); *Y10S 439/902* (2013.01)

(58) Field of Classification Search
CPC ..... H01R 13/6215; H01R 13/5841; H01R 13/5833; H01R 13/443; H01R 13/567; Y10S 439/902
USPC ..... 439/881, 855, 902, 694, 501, 528, 456, 439/457, 362
See application file for complete search history.

(56) References Cited

U.S. PATENT DOCUMENTS 5,848,916 A * 12/1998 Huang ..... F21V 19/0005 439/619
2015/0340806 A1* 11/2015 Ilkhanov ..... H01R 13/6215 439/278

* cited by examiner

*Primary Examiner* — Abdullah Riyami
*Assistant Examiner* — Justin Kratt
(74) *Attorney, Agent, or Firm* — FisherBroyles, LLP

(57) ABSTRACT

The disclosed apparatus includes (1) a right-angle power plug that (A) plugs into a computing device and (B) facilitates feeding electrical power to the computing device when plugged into the computing device and (2) at least one power cable that is electrically coupled to the right-angle power plug at a right angle such that the power cable runs perpendicular to the right-angle power plug. Various other apparatuses, systems, and methods are also disclosed.

13 Claims, 13 Drawing Sheets

APPARATUS, SYSTEM, AND METHOD FOR ACHIEVING POWER CONNECTIONS IN SPACE-LIMITED COMPUTING ENVIRONMENTS

BACKGROUND

Computing environments often have certain physical space limitations. For example, an enclosed network rack may be designed to house several rackmount network devices. In this example, the enclosed network rack may include a front door and/or a back door. However, the enclosure may provide only limited space between the rackmount network devices and the doors. As a result, to properly close the doors on the network rack, any external components that support the rackmount network devices may need to fit within a very tight space in the enclosure.

As a specific example, an enclosed network rack may have only about 1.5 inches between the mounted network devices and the doors of the enclosure. In this example, some of those mounted network devices may require one or more external power cables for operation. Unfortunately, many traditional power cables capable of supporting such rackmount network devices may have plugs that exceed 1.5 inches in depth. As a result, upon plugging one of those power cables into a network device mounted to the rack, the corresponding door of the enclosure may be unable to fully and/or properly close, thereby impeding the functionality and/or undermining the purpose of the enclosure.

The instant disclosure, therefore, identifies and addresses a need for improved and/or additional apparatuses, systems, and methods for achieving power connections in space-limited computing environments.

SUMMARY

As will be described in greater detail below, the instant disclosure generally relates to apparatuses, systems, and methods for achieving power connections in space-limited computing environments. In one example, an apparatus for accomplishing such a task may include (1) a right-angle power plug that (A) plugs into a computing device and (B) facilitates feeding electrical power to the computing device when plugged into the computing device and (2) at least one power cable that is electrically coupled to the right-angle power plug at a right angle such that the power cable runs perpendicular to the right-angle power plug.

Similarly, a right-angle power plug may include (1) a connector that mates with a connector of a computing device, (2) at least one power cable that (A) is electrically coupled to the connector of the right-angle power plug and (B) carries electrical power to the computing device through the connector of the right-angle power plug, and (3) a body that houses an interface at which the power cable is electrically coupled to the connector of the right-angle power plug, wherein the body and the power cable form a right angle such that the power cable runs perpendicular to the body.

A corresponding method may include (1) forming a right-angle power plug that (A) plugs into a computing device and (B) facilitates feeding electrical power to the computing device when plugged into the computing device and (2) electrically coupling a power cable to a right-angle power plug at a right angle such that the power cable runs perpendicular to the right-angle power plug.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
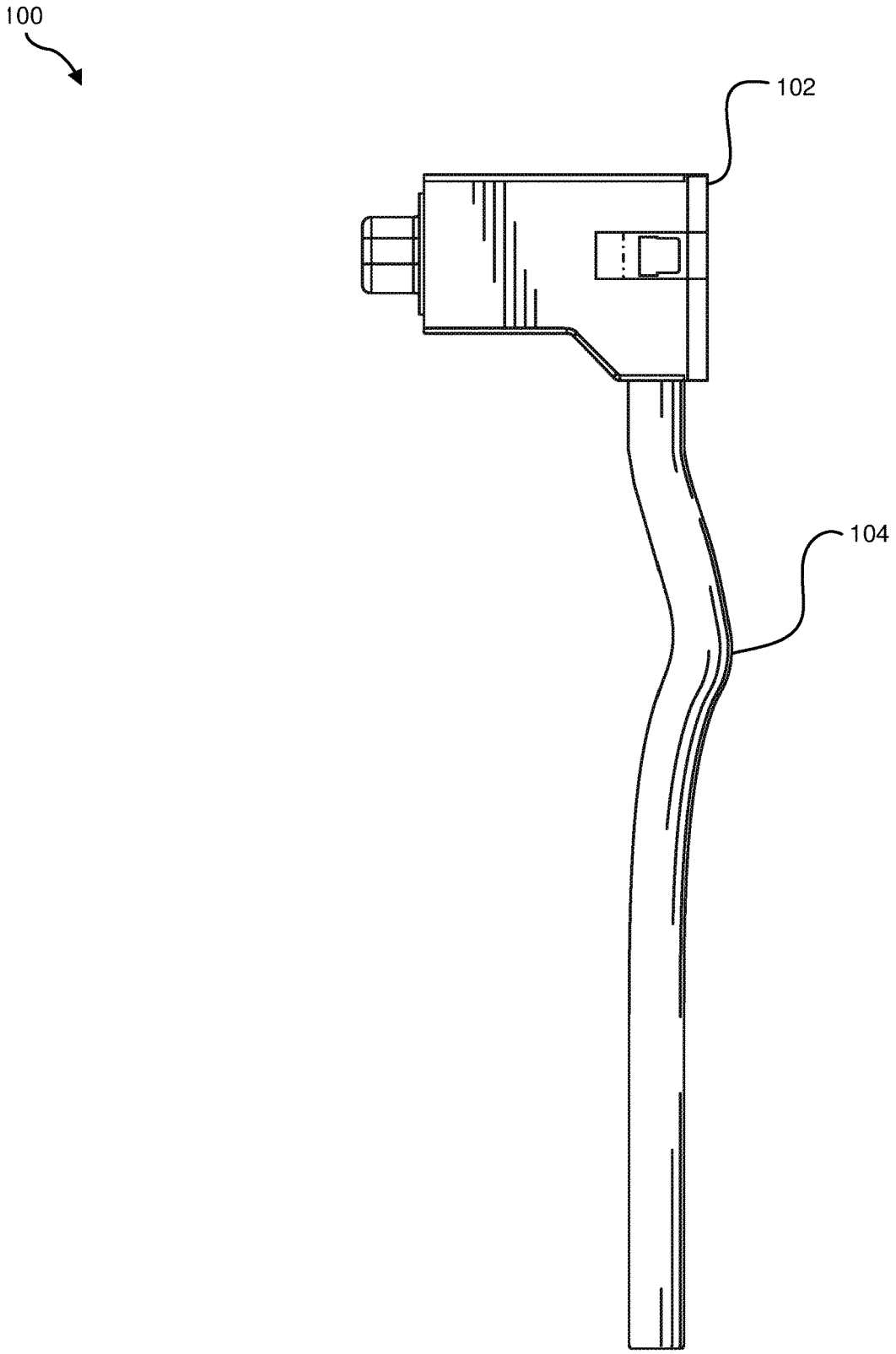
FIG. 1 is an illustration of an exemplary apparatus for achieving power connections in space-limited computing environments.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure describes various apparatuses, systems, and methods for achieving power connections in space-limited computing environments. As will be explained in greater detail below, embodiments of the instant disclosure may include, involve, and/or provide a right-angle power plug that plugs into a computing device and carries electrical power to the computing device. In addition, embodiments of the instant disclosure may include, involve, and/or provide power cables that are electrically coupled to the power plug at a right angle. In other words, the power cables may project and/or jut out of the power plug at an approximately 90-degree angle. By projecting and/or jutting out of the power plug in this way, the power cables may enable the power plug to make a power connection in tighter spaces than traditional straight power plugs.

Embodiments of the instant disclosure may also include, involve, and/or provide a cable management solution that facilitates holding power cables to the body of a right-angle power plug. In one example, the power cables held to the body of the right-angle power plug may originate from and/or be electrically coupled to another right-angle power plug. For example, a set of right-angle power plugs may be plugged into an enclosed network device mounted to a network rack. In this example, one of the right-angle power plugs may include some grooves that are fitted to hold the power cables that originate from and/or are electrically coupled to the other right-angle power plug. In doing so, the grooves may serve to manage and/or guide the power cables within the enclosure to prevent and/or avoid tangling and/or knotting with one another.

The following will provide, with reference to FIGS. 1-12, examples of apparatuses, power plugs, and other components that facilitate power connections in space-limited computing environments. In addition, detailed descriptions of methods for achieving power connections in space-limited computing environments will be provided with reference to FIG. 13.

FIG. 1 is an illustration of an exemplary apparatus 100 for achieving power connections in space-limited computing environments. As illustrated in this figure, exemplary apparatus 100 may include a right-angle power plug 102 and a power cable 104. In this example, power cable 104 may be electrically coupled to right-angle power plug 102 at a right angle. The term "right angle," as used herein, generally refers to an angle of approximately 90 degrees. In one example, a right angle may form at the intersection of two perpendicular lines.

Accordingly, in apparatus 100, power cable 104 may run perpendicular to right-angle power plug 102. In some examples, right-angle power plug 102 may be fitted to connect and/or secure to a computing device. In such examples, power cable 104 may project and/or jut out of right-angle power plug 102 at an approximately 90-degree angle from the plane on which the right-angle power plug 102 connects and/or secures to the computing device.

In one example, right-angle power plug 102 may plug into a computing device that is mounted to an enclosed network rack. When plugged into the computing device, right-angle power plug 102 may facilitate feeding electrical power to the computing device by way of power cable 104. Examples of such a computing device include, without limitation, rack-mount network devices, routers, switches, hubs, modems, bridges, repeaters, gateways, multiplexers, network adapters, network interfaces, network racks, chasses, laptops, tablets, desktops, servers, network devices, storage devices, client devices, cellular phones, Personal Digital Assistants (PDAs), multimedia players, embedded systems, wearable devices (e.g., smart watches, smart glasses, etc.), gaming consoles, portions of one or more of the same, combinations or variations of one or more of the same, and/or any other suitable computing device.

Right-angle power plug 102 may include various components that support the consistent feeding of electrical power to the computing device. For example, right-angle power plug 102 may include various components that facilitate the transfer of electricity, such as conductors, wires, cords, contacts, jacks, and/or electrical connectors. Right-angle power plug 102 may also include various components that facilitate establishing and/or ensure a reliable physical and/or electrical connection to the computing device, such as retentions screws, screw holes, physical connectors, and/or sockets.

Similarly, power cable 104 may include various components that support the consistent feeding of electrical power to the computing device. For example, power cable 104 may include various components that facilitate the transfer of electricity, such as conductors, wires, cords, contacts, jacks, and/or electrical connectors. Power cable 104 may also include various components designed to prevent against electric shock and/or short circuits, such as insulation, sheathing, and/or non-conductive material.

Right-angle power plug 102 and power cable 104 may facilitate the transfer of any type or form of electrical power. In one example, right-angle power plug 102 and power cable 104 may facilitate the transfer of Alternating Current (AC) power. In another example, right-angle power plug 102 and power cable 104 may facilitate the transfer of Direct Current (DC) power.

In some examples, power cable 104 may also be electrically connected and/or coupled to a power source and/or power supply module (not illustrated in FIG. 1). For example, power cable 104 may be electrically connected and/or coupled to right-angle power plug 102 on one side and to a power source and/or power supply module on the other side. In this example, once right-angle power plug 102 is plugged into the computing device, power cable 104 may carry and/or provide electrical power to the computing device via right-angle power plug 102.

Figure 2:
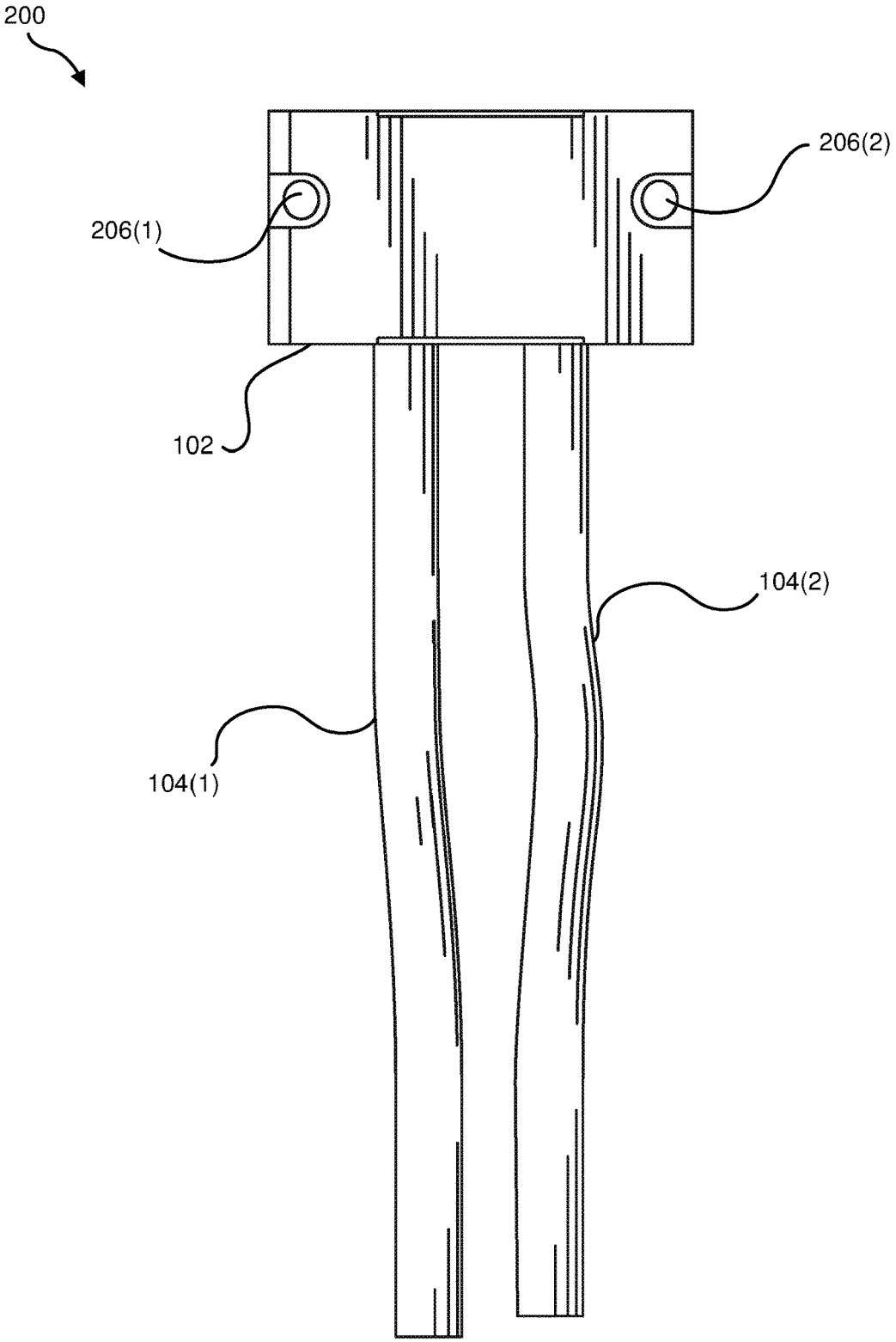
FIG. 2 is an illustration of an exemplary apparatus for achieving power connections in space-limited computing environments.

FIG. 2 is a backside-view illustration of an exemplary apparatus 200 for achieving power connections in space-limited computing environments. As illustrated in this figure, exemplary apparatus 200 may include right-angle power plug 102 and multiple power cables 104(1) and 104(2). In this example, power cable 104 may be electrically coupled to right-angle power plug 102 at a right angle.

Right-angle power plug 102 may include holes 206(1) and 206(2) that are each fitted to accept and/or hold a retention screw that secures right-angle power plug 102 to a computing device. In some examples, holes 206(1) and 206(2) may be threaded and/or tapered. In other examples, holes 206(1) and 206(2) may be unthreaded and/or untapered.

Figure 3:
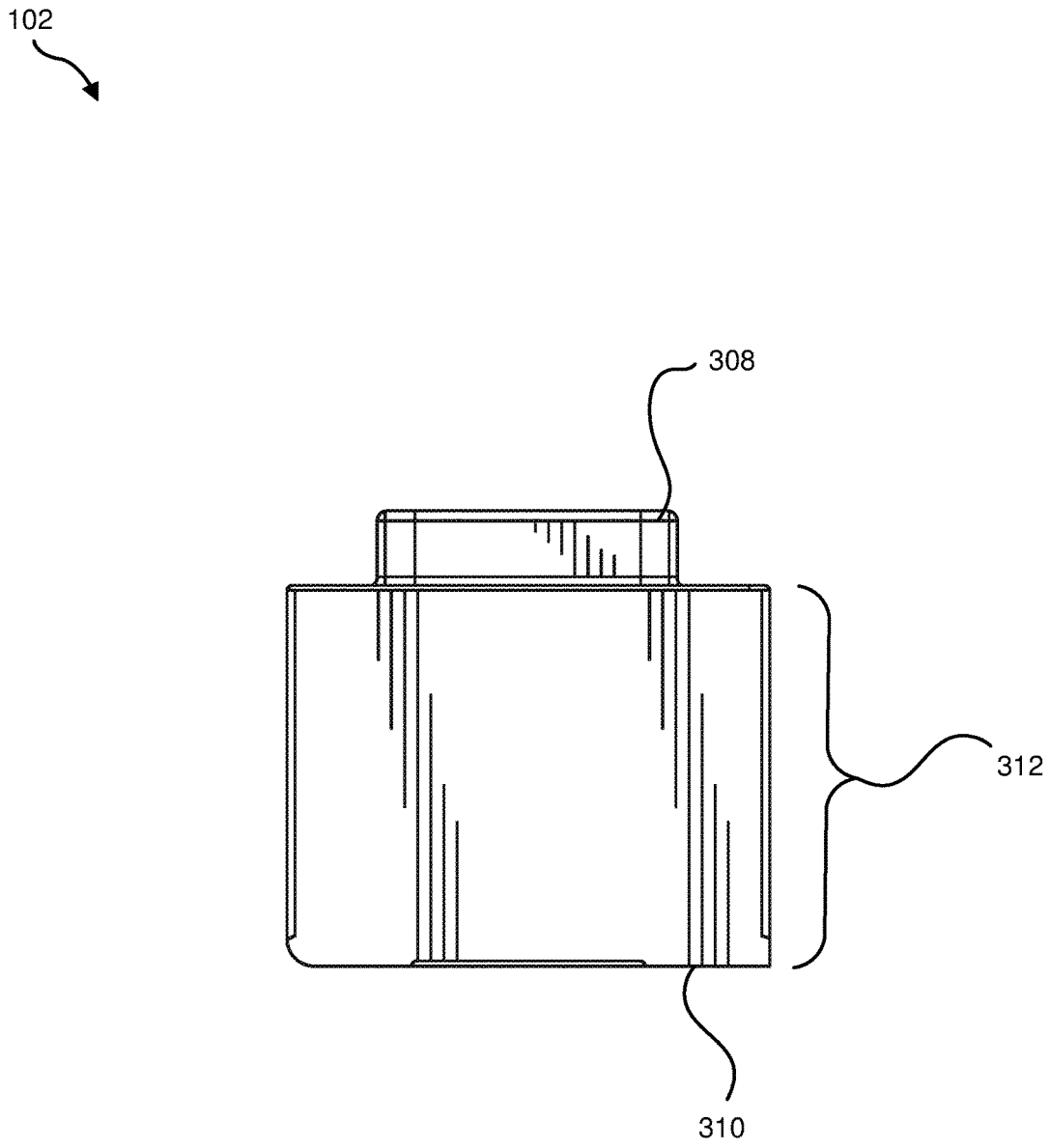
FIG. 3 is an illustration of an exemplary right-angle power plug capable of making a power connection in space-limited computing environments.

FIG. 3 is a top-view illustration of exemplary right-angle power plug 102 for achieving power connections in space-limited computing environments. As illustrated in this figure, exemplary right-angle power plug 102 may include a body 310 and a connector 308. In one example, body 310 may house an interface and/or electrical connection point at which power cable 104 (not illustrated in FIG. 3) is electrically coupled to right-angle power plug 102. In this example, connector 308 may mate with a connector on a computing device when right-angle power plug 102 is plugged into the computing device. In other words, right-angle power plug 102 may be physically and/or electrically coupled and/or secured to the computing device by fastening connector 308 to the connector on the computing device.

Body 310 may include and/or represent a casing and/or cover that at least partially surrounds the interface at which power cable 104 establishes an electrical connection with connector 308. Body 310 may include and/or incorporate a variety of different materials. In some examples, body 310 may be composed of non-conductive and/or insulative materials, such as plastics, rubbers, and/or ceramics. In such examples, the power carried by power cable 104 may avoid being passed through body 310 on the way to the computing device.

Connector 308 may include and/or represent any type or form of full or partial fastener, fitting, and/or coupling that facilitates a physical, mechanical, and/or electrical connection with the computing device. In one example, connector 308 may include and/or represent a female receptacle that mates with a male member on the computing device. In another example, connector 308 may include and/or represent a male member that mates with a female receptacle on the computing device. Either way, connector 308 may include conductive material that facilitates the transfer of electrical power to the computing device. Accordingly, the power carried by power cable 104 may be passed through connector 308 on the way to the computing device.

As illustrated in FIG. 3, body 310 of right-angle power plug 102 may have a depth 312, which corresponds to and/or represents the dimension sometimes referred to as width. In one example, depth 312 may correspond to and/or represents the length and/or distance between the side where the connector is located on body 310 and the opposite side of body 310. Since power plug 102 is right-angled and/or power cable 104 connects with body 310 at a right angle, the size of body 310 may be reduced and/or decreased relative to the body of traditional straight power plugs. As a result, right-angle power plug 102 may be able to fit and/or make electrical connections in tighter spaces than traditional straight power plugs.

As a specific example, body 310 of right-angle power plug 102 may have a depth 312 that is equal to or less than 1.5 inches. Since, in this example, body 310 of right-angle power plug 102 is so small and power cable 104 projects and/or juts out of body 310 at a right angle, power plug 102 may be able to fit and/or make an electrical connection with a network device mounted to an enclosed network rack. In this example, due to the design of power plug 102, the doors of the network rack may be able to fully close even in the event that the amount of space between the mounted network device and the doors is only 1.5 inches.

Figure 4:
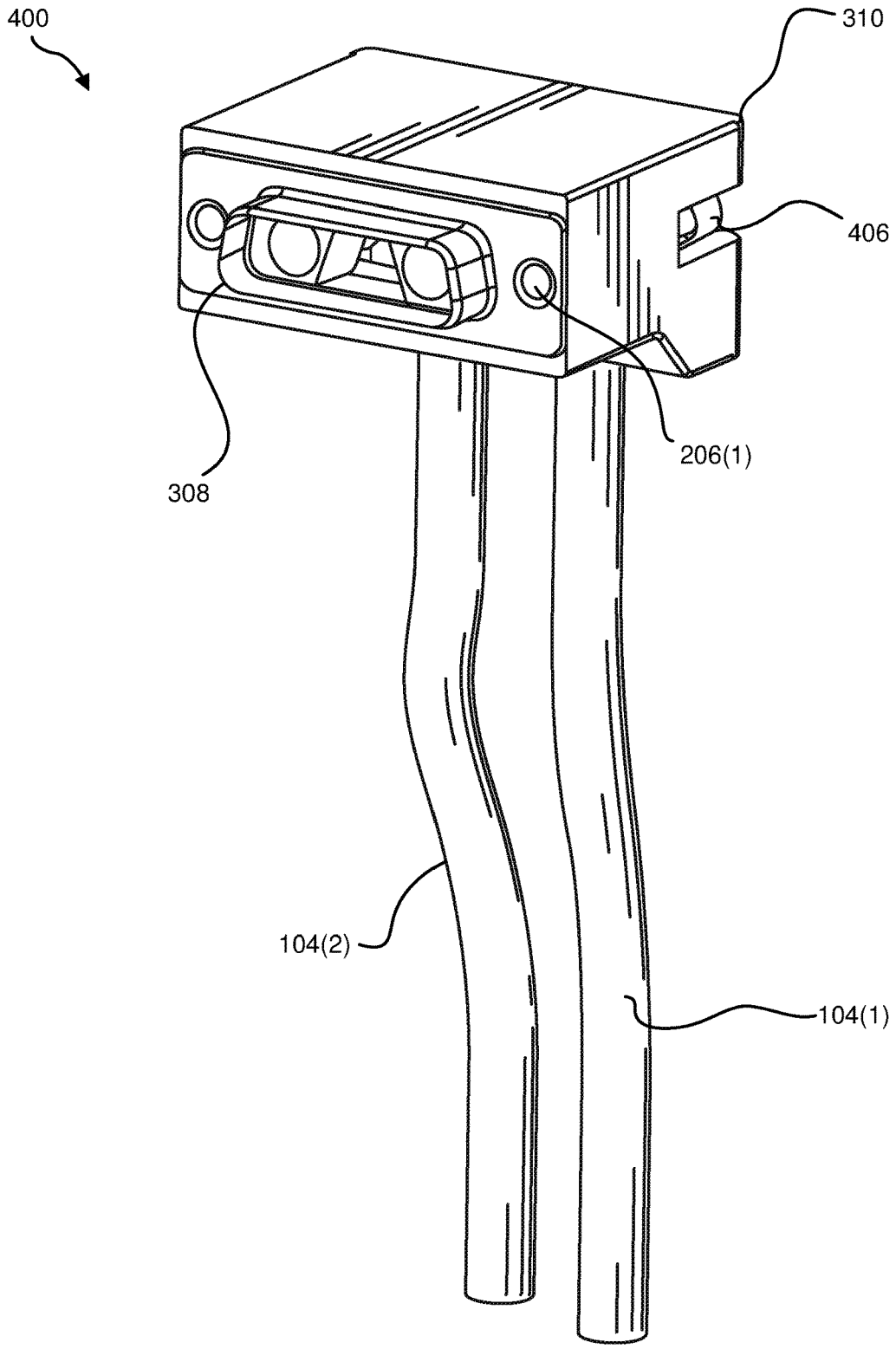
FIG. 4 is an illustration of an exemplary apparatus for achieving power connections in space-limited computing environments.

FIG. 4 is a frontside-view illustration of an exemplary apparatus 400 for achieving power connections in space-limited computing environments. As illustrated in this figure, exemplary apparatus 400 may include right-angle power plug 102 and multiple power cables 104(1) and 104(2). In this example, right-angle power plug 102 may include body 310 and connector 308. Power cables 104(1) and 104(2) may be electrically coupled to right-angle power plug 102 at a right angle.

As illustrated in FIG. 4, apparatus 400 may include a retention screw 406 that fits inside hole 206(1). In this example, retention screw 406 may secure right-angle power plug 102 to a computing device. For example, a computing device may include a connector that mates with connector 308 of right-angle power plug 102. Adjacent to that connector, the computing device may also have at least one threaded hole that is fitted to accept and/or hold retention screw 406. When the connectors are mated together, retention screw 406 may be tightened into the threaded hole of the computing device. As retention screw 406 is tightened in this way, the amount of physical tension and/or support provided by retention screw 406 may increase.

Figure 5:
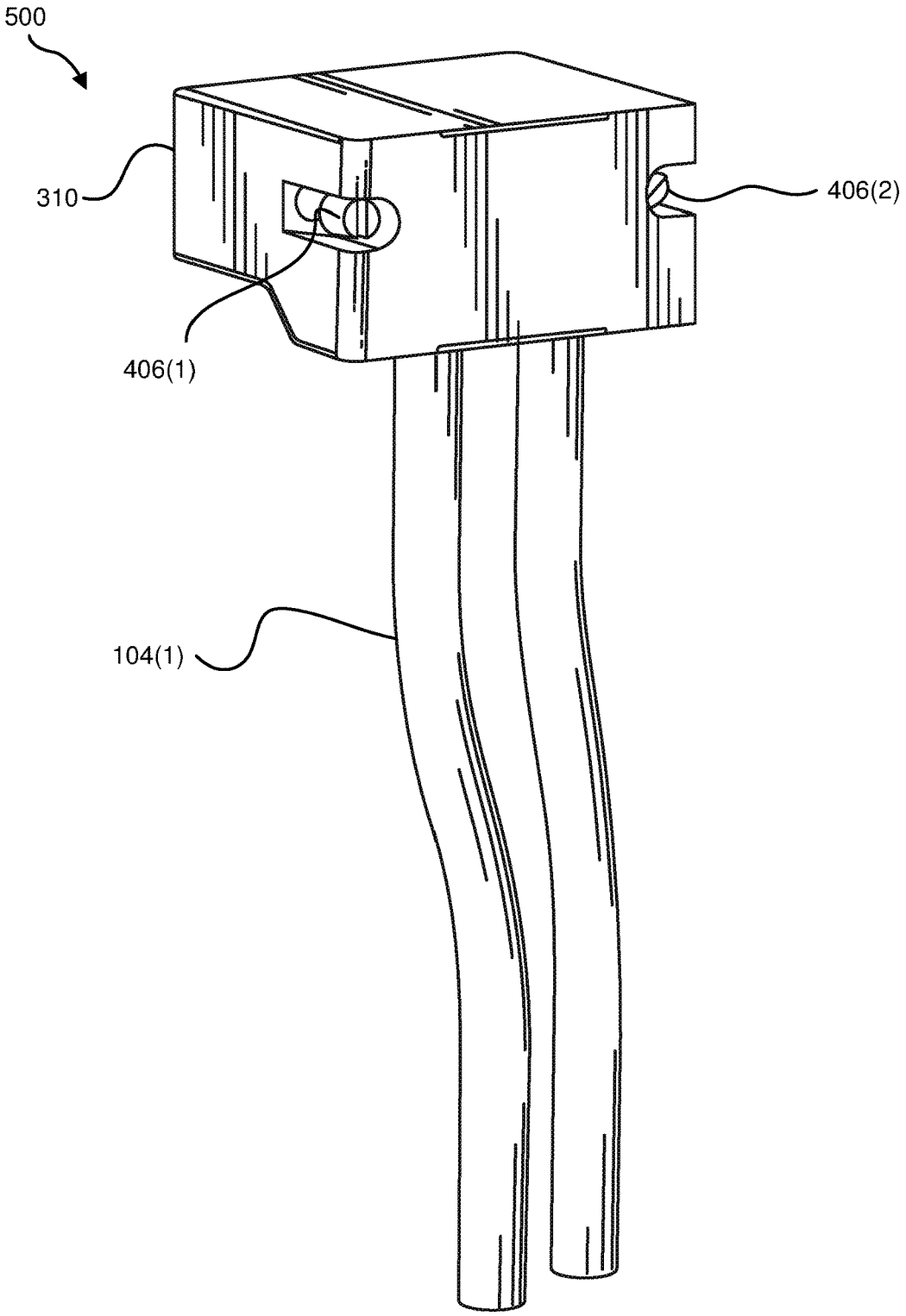
FIG. 5 is an illustration of an exemplary apparatus for achieving power connections in space-limited computing environments.

FIG. 5 is a backside-view illustration of an exemplary apparatus 500 for achieving power connections in space-limited computing environments. As illustrated in this figure, exemplary apparatus 500 may include right-angle power plug 102 and multiple power cables. In this example, right-angle power plug 102 may include body 310 and connector 308 (not explicitly visible in FIG. 5).

As illustrated in FIG. 5, apparatus 500 may include retention screws 406(1) and 406(2) that fit inside holes formed by body 310 of right-angle power plug 102. In this example, retention screws 406(1) and 406(2) may pass through those holes in body 310 to reach threaded holes formed by a computing device. Retention screws 406(1) and 406(2) may tighten to those threaded holes on the computing device. As retention screws 406(1) and 406(2) are tightened to those threaded holes, the amount of physical tension and/or support provided by retention screws 406(1) and 406(2) may increase, thereby securing right-angle power plug 102 to the computing device.

Figure 6:
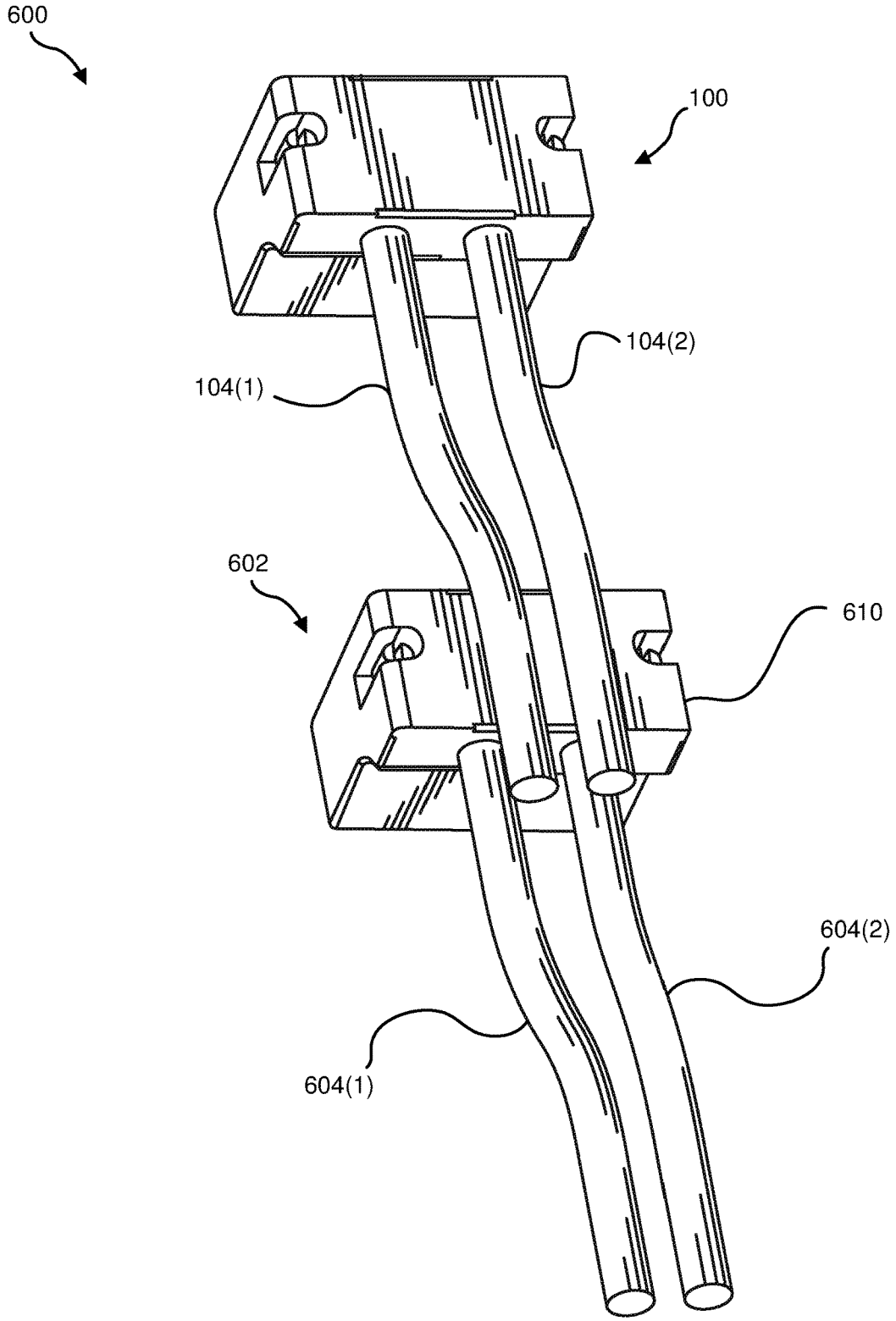
FIG. 6 is an illustration of an exemplary implementation of apparatuses for achieving power connections in space-limited computing environments.

FIG. 6 is an illustration of an exemplary implementation 600 of apparatuses for achieving power connections in space-limited computing environments. As illustrated in this figure, exemplary implementation 600 may include apparatus 100 and an apparatus 602. In one example, apparatus 602 may represent another instance of apparatus 100 and/or be substantially identical to apparatus 100. For example, apparatus 602 may include and/or represent a right-angle power plug and power cables 604(1) and 604(2). In this example, the right-angle power plug may include a body 610 and a connector (not explicitly visible in FIG. 6) that facilitates connecting the right-angle power plug to a computing device.

Body 610 may house an interface and/or electrical connection point at which power cables 604(1) and 604(2) are electrically coupled to the connector of right-angle power plug 102. In this example, power cables 604(1) and 604(2) may also be electrically coupled to a power source and/or power supply module (not illustrated in FIG. 6) that provides and/or supplies electrical power to a computing device by way of the right-angle power plug.

In some examples, the right-angle power plugs of both apparatus 100 and apparatus 602 may be plugged into the same computing device. In other examples, the right-angle power plugs of both apparatus 100 and apparatus 602 may be plugged into different computing devices. For example, the right-angle power plug of apparatus 100 may be plugged into one network device mounted to an enclosed network rack. In this example, the right-angle power plug of apparatus 602 may be plugged into another network device mounted to the enclosed network rack. Either way, power cables 104(1) and 104(2) of apparatus 100 may be configured and/or arranged to overlay and/or abut against the backside of body 610 of apparatus 602.

Figure 7:
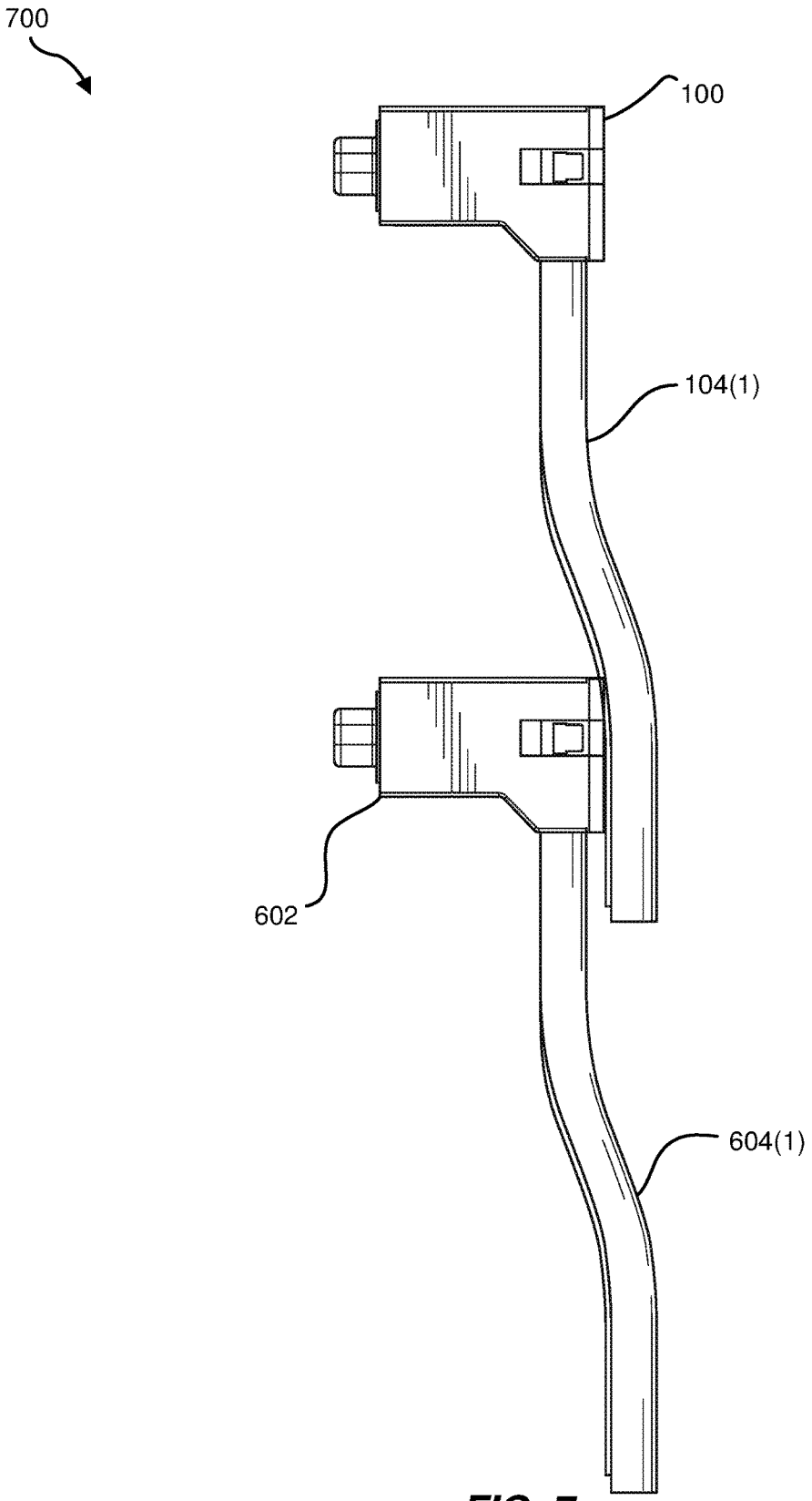
FIG. 7 is an illustration of an exemplary implementation of apparatuses for achieving power connections in space-limited computing environments.

FIG. 7 is a side-view illustration of an exemplary implementation 700 of apparatuses for achieving power connections in space-limited computing environments. As illustrated in this figure, exemplary implementation 700 may include apparatus 100 and apparatus 602. In one example, power cables 104(1) and 104(2) of apparatus 100 may be configured and/or arranged to overlay and/or abut against the backside of body 610 of apparatus 602.

Figure 8:
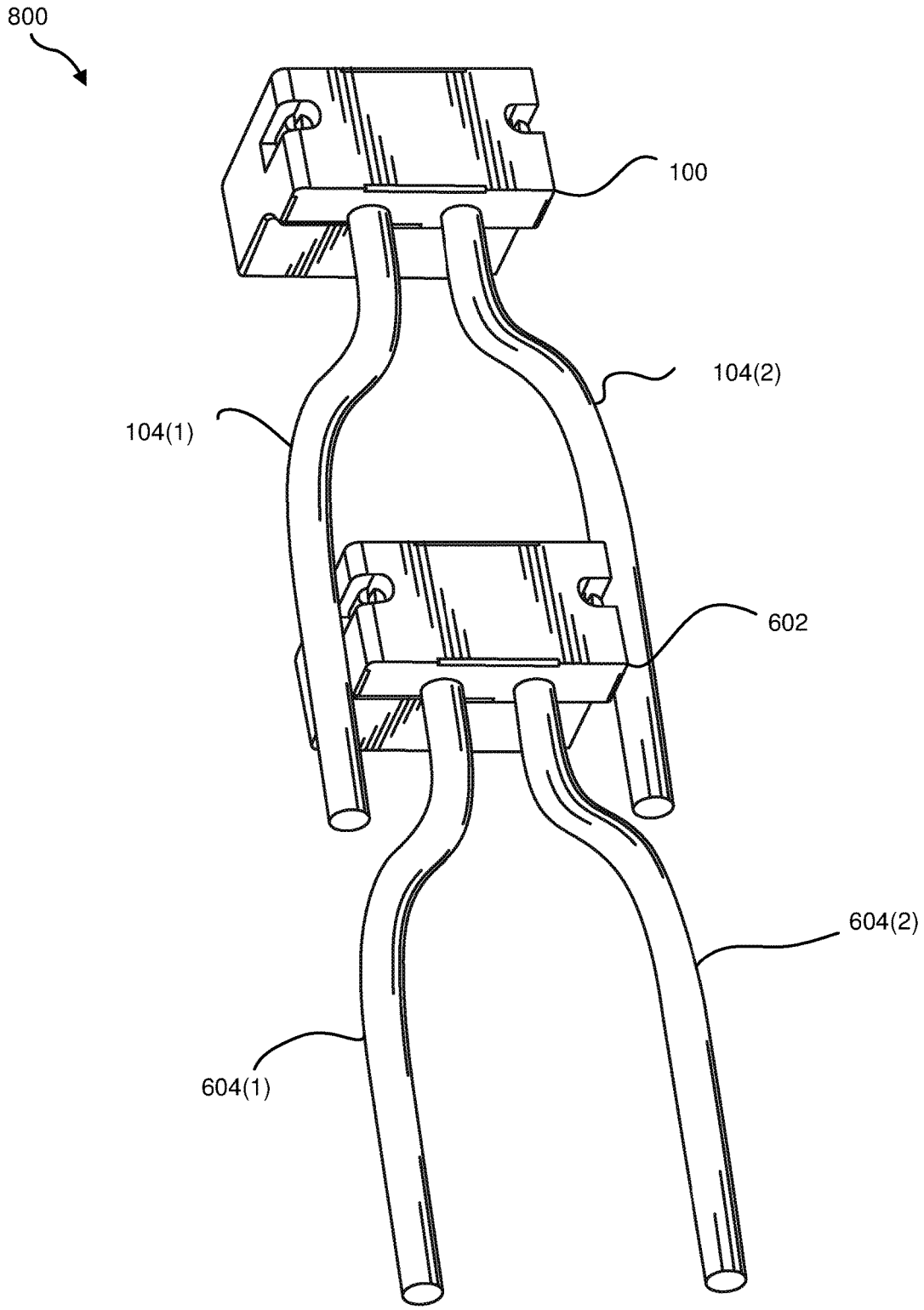
FIG. 8 is an illustration of an exemplary implementation of apparatuses for achieving power connections in space-limited computing environments.

FIG. 8 is an illustration of an exemplary implementation 800 of apparatuses for achieving power connections in space-limited computing environments. As illustrated in this figure, exemplary implementation 800 may include apparatus 100 and apparatus 602. In one example, power cables 104(1) and 104(2) of apparatus 100 may be configured and/or arranged to overlay and/or abut against opposing sides of body 610 of apparatus 602. For example, power cable 104(1) may be configured and/or arranged to rest against the left side of body 610 in FIG. 8, and power cable 104(2) may be configured and/or arranged to rest against the right side of body 610 in FIG. 8.

Figure 9:
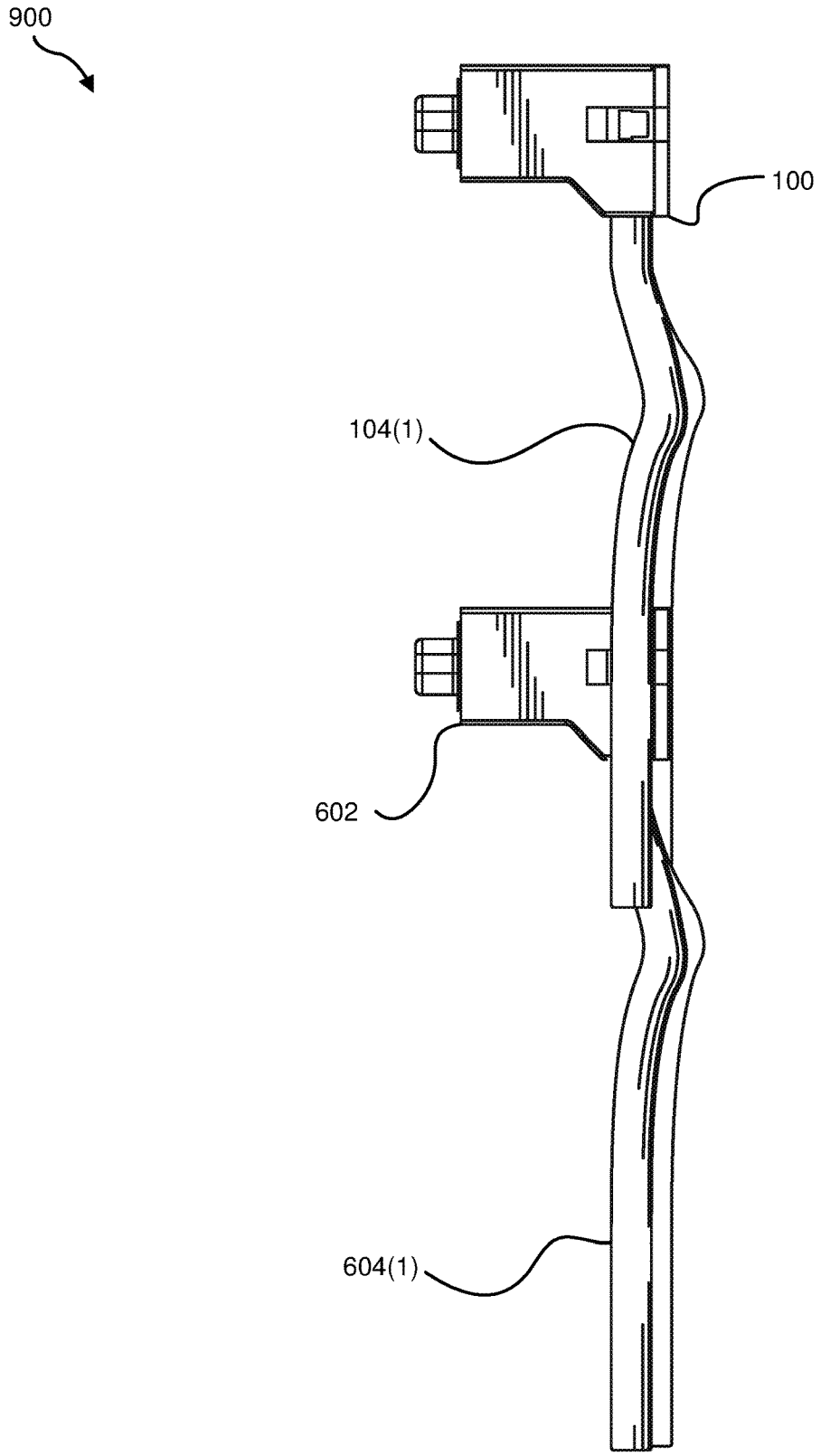
FIG. 9 is an illustration of an exemplary implementation of apparatuses for achieving power connections in space-limited computing environments.

FIG. 9 is a side-view illustration of an exemplary implementation 900 of apparatuses for achieving power connections in space-limited computing environments. As illustrated in this figure, exemplary implementation 900 may include apparatus 100 and apparatus 602. Like in FIG. 8, power cables 104(1) and 104(2) of apparatus 100 may be configured and/or arranged to overlay and/or abut against opposing sides of body 610 of apparatus 602. For example, power cable 104(1) may be configured and/or arranged to rest against the left side of body 610, and power cable 104(2) may be configured and/or arranged to rest against the right side of body 610.

Figure 10:
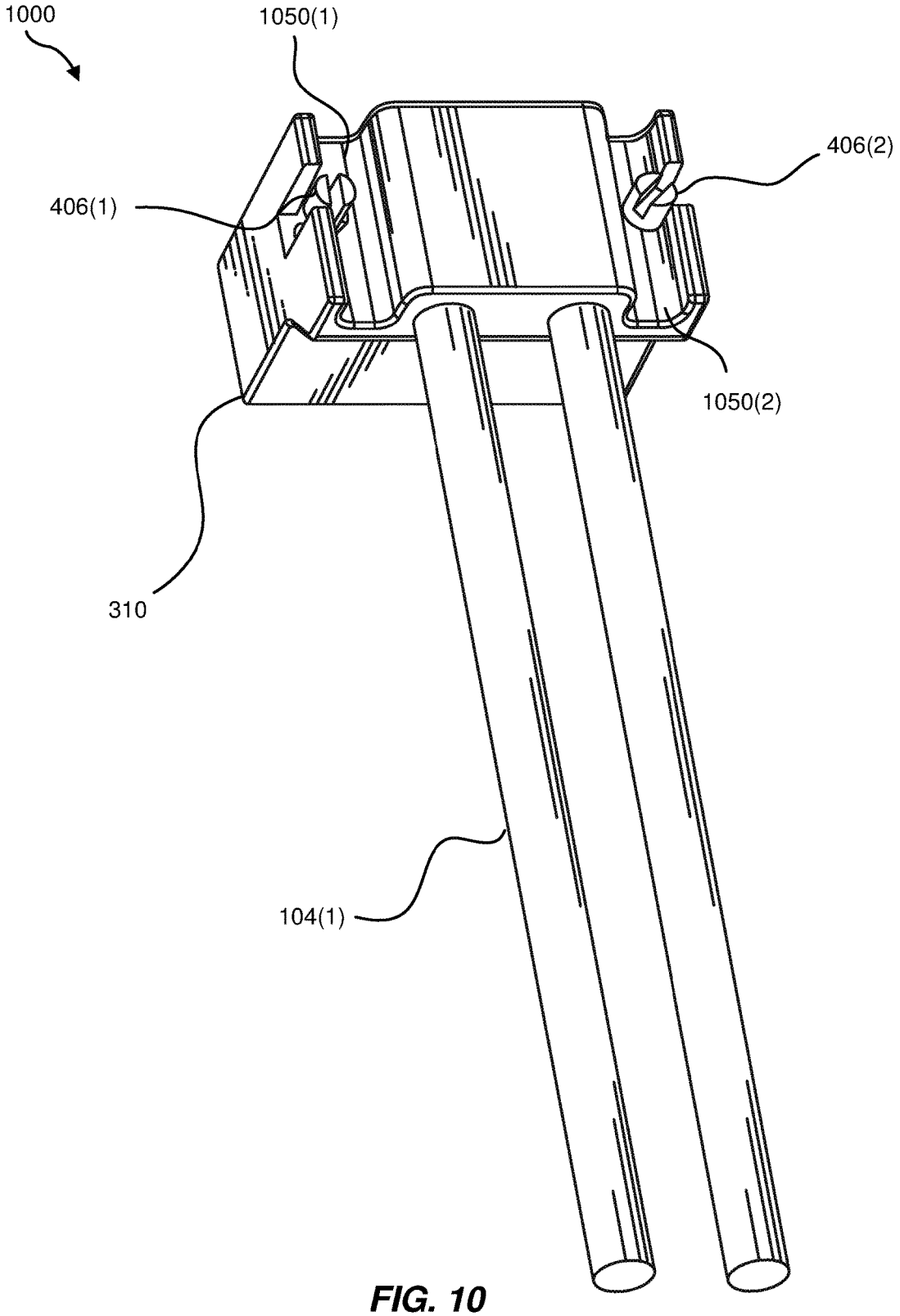
FIG. 10 is an illustration of an exemplary apparatus for achieving power connections in space-limited computing environments.

FIG. 10 is a backside-view illustration of an exemplary apparatus 1000 for achieving power connections in space-limited computing environments. As illustrated in this figure, exemplary apparatus 1000 may include a right-angle power plug and multiple power cables. In this example, the power cables may be electrically coupled to the right-angle power plug at a right angle. The right-angle power plug may include body 310 and a connector (not explicitly visible in FIG. 10).

As illustrated in FIG. 10, body 310 of the right-angle power plug may include grooves 1050(1) and 1050(2) that are fitted to accept and/or hold additional power cables (not illustrated in FIG. 10) that are electrically coupled to an additional right-angle power plug (not illustrated in FIG. 10). In one example, grooves 1050(1) and 1050(2) may represent indentations and/or channels designed to hold and/or guide power cables as part of a cable management solution. In this example, the cable management solution may enable body 310 to maintain and/or contain additional power cables such that their circumferences do not extend beyond the depth dimension of body 310. For example, the cable management solution may hold the power cables such that their circumferences remain internal to body 310 and/or flush with the backside of body 310.

In one example, grooves 1050(1) and 1050(2) may be arranged and/or formed on opposite sides of body 310 of the right-angle power plug. For example, groove 1050(1) may be arranged and/or formed on the left side of body 310 in FIG. 10, and groove 1050(2) may be arranged and/or formed on the right side of body 310 in FIG. 10.

As illustrated in FIG. 10, the holes that are fitted to accept retention screws 406(1) and 406(2) may intersect with grooves 1050(1) and 1050(2). In this example, retention screws 406(1) and 406(2) may need to be tightened and/or inserted into the retention holes before the additional power cables are placed into grooves 1050(1) and 1050(2) for holding. When retention screws 406(1) and 406(2) are fully tightened to secure the right-angle power plug to a computing device, retention screws 406(1) and 406(2) may be recessed into grooves 1050(1) and 1050(2), respectively. Once recessed sufficiently, retention screws 406(1) and 406(2) may no longer impede the placement of the additional power cables power cables in grooves 1050(1) and 1050(2).

Figure 11:
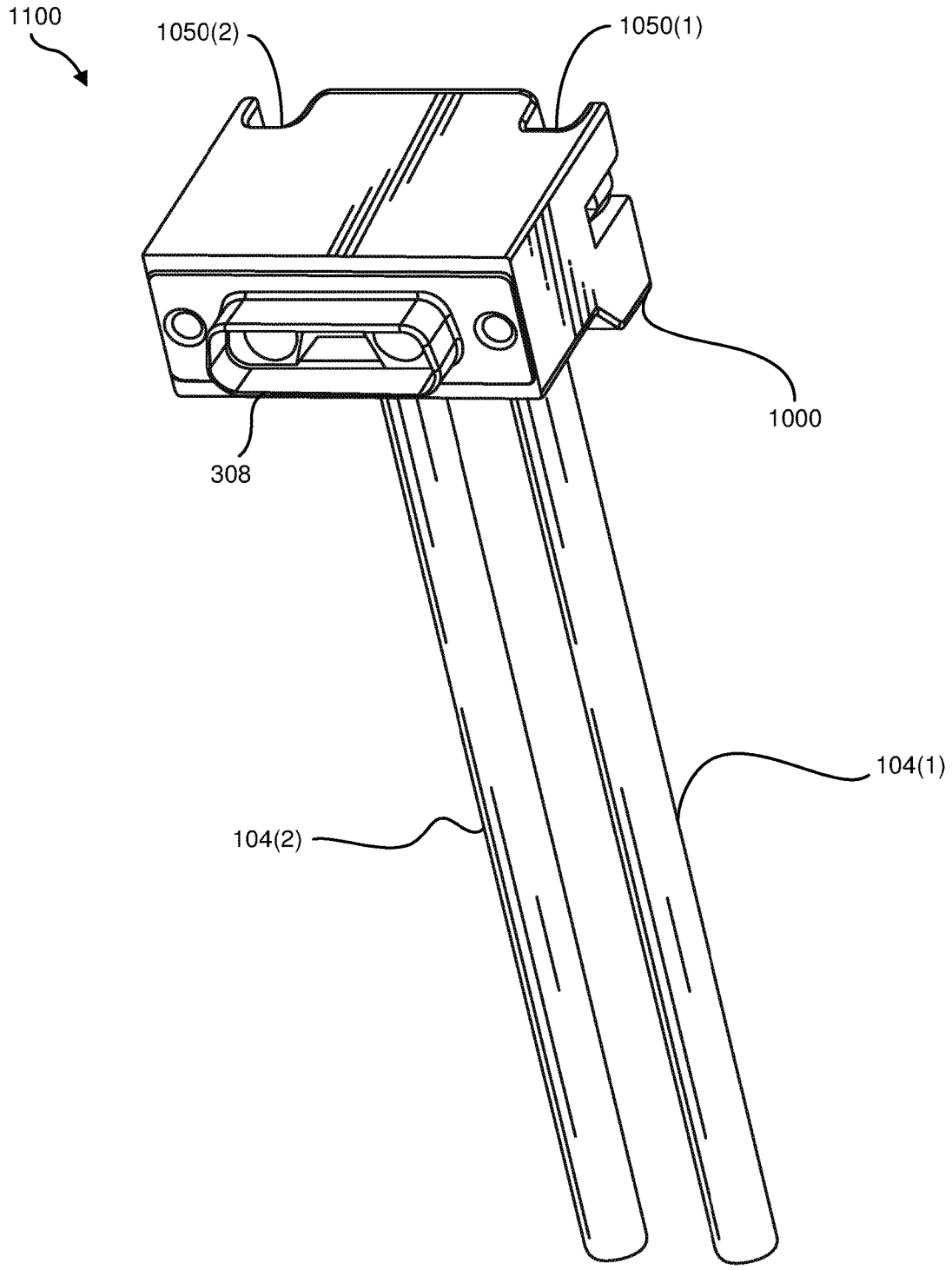
FIG. 11 is an illustration of an exemplary apparatus for achieving power connections in space-limited computing environments.

FIG. 11 is a frontside-view illustration of an exemplary apparatus 1100 for achieving power connections in space-limited computing environments. As illustrated in this figure, exemplary apparatus 1100 may include a right-angle power plug and multiple power cables. In this example, the power cables may be electrically coupled to the right-angle power plug at a right angle. The right-angle power plug may include a body and connector 308. Body 310 may include grooves 1050(1) and 1050(2) that are fitted to accept and/or hold additional power cables (not illustrated in FIG. 11) that are electrically coupled to an additional right-angle power plug (not illustrated in FIG. 11).

Figure 12:
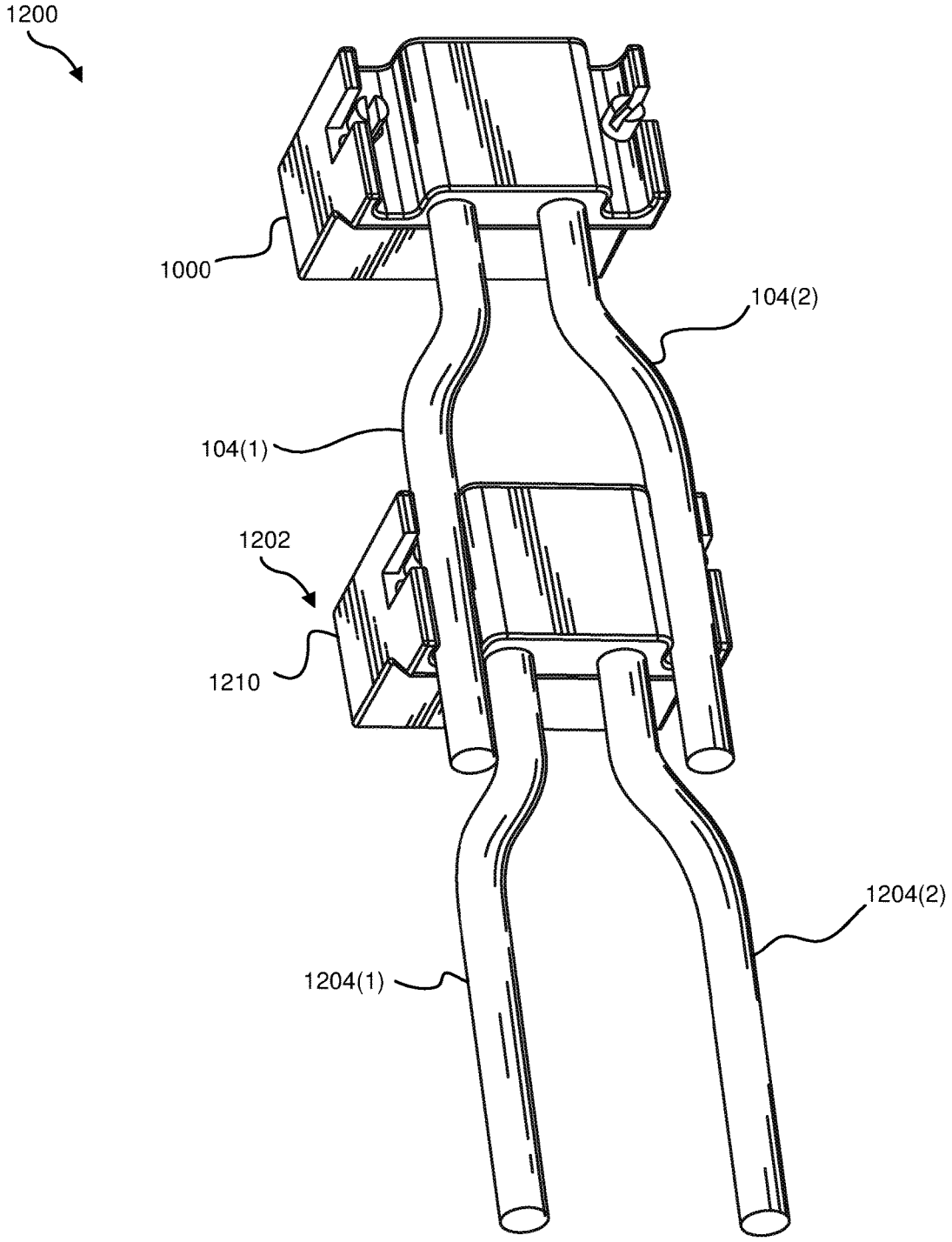
FIG. 12 is an illustration of an exemplary implementation of apparatuses for achieving power connections in space-limited computing environments.

FIG. 12 is an illustration of an exemplary implementation 1200 of apparatuses for achieving power connections in space-limited computing environments. As illustrated in this figure, exemplary implementation 1200 may include apparatus 1000 and apparatus 1202. In one example, apparatus 1202 may represent another instance of apparatus 1000 and/or be substantially identical to apparatus 1000. For example, apparatus 1202 may include and/or represent a right-angle power plug and power cables 1204(1) and 1204(2). In this example, the right-angle power plug may include a body 1210 and a connector (not explicitly visible in FIG. 12) that facilitates connecting the right-angle power plug to a computing device.

Body 1210 may house an interface and/or electrical connection point at which power cables 1204(1) and 1204(2) are electrically coupled to the connector of the right-angle power plug. In this example, power cables 1204(1) and 1204(2) may also be electrically coupled to a power source and/or power supply module (not illustrated in FIG. 12) that provides and/or supplies electrical power to a computing device by way of the right-angle power plug.

In some examples, the right-angle power plugs of both apparatus 1000 and apparatus 1202 may be plugged into the same computing device. In other examples, the right-angle power plugs of both apparatus 1000 and apparatus 1202 may be plugged into different computing devices. For example, the right-angle power plug of apparatus 1000 may be plugged into one network device mounted to an enclosed network rack. In this example, the right-angle power plug of apparatus 1202 may be plugged into another network device mounted to the enclosed network rack. Either way, power cables 104(1) and 104(2) of apparatus 1000 may be held, guided, and/or maintained in position against body 1210 of apparatus 1202 by grooves. For example, power cable 104(1) may be held and/or contained by the groove on the left side of body 1210 in FIG. 12, and power cable 104(2) may be held and/or contained by the groove rest on the right side of body 1210 in FIG. 12.

Figure 13:
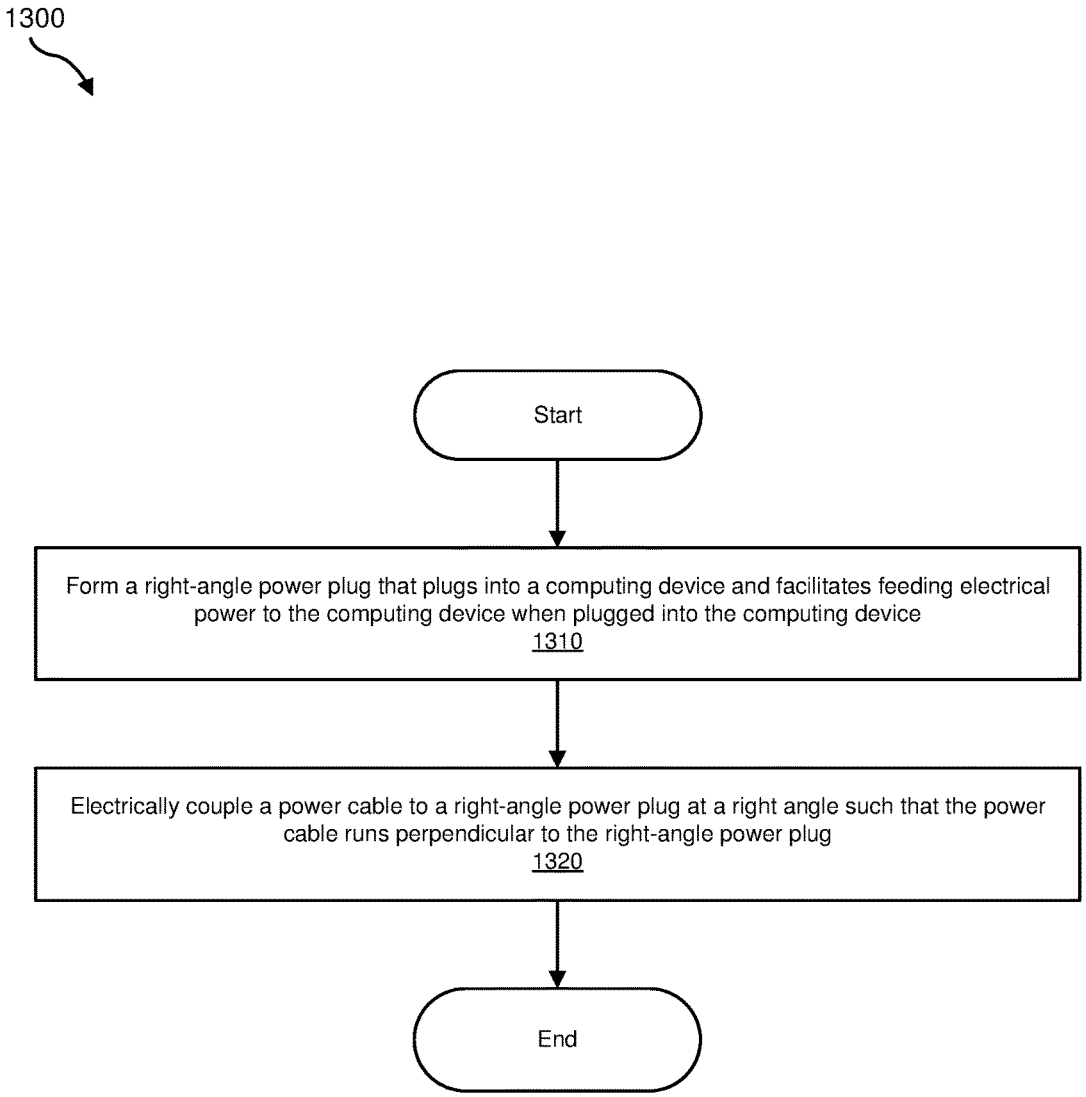
FIG. 13 is a flow diagram of an exemplary method for achieving power connections in space-limited computing environments.

FIG. 13 is a flow diagram of an exemplary method 1300 for achieving power connections in space-limited computing environments. Method 1300 may include the step of forming a right-angle power plug that plugs into a computing device and facilitates feeding electrical power to the computing device when plugged into the computing device (1310). This forming step may be performed in a variety of ways. For example, a power-plug equipment manufacturer may manually and/or robotically form a right-angle power plug that plugs into a computing device. When plugged into the computing device, this right-angle power plug may facilitate feeding electrical power to the computing device.

Returning to FIG. 13, method 1300 may also include the step of electrically coupling the power cable to the right-angle power plug at a right angle such that the power cable runs perpendicular to the right-angle power plug (1320). This coupling step may be performed in a variety of ways. For example, the power-plug equipment manufacturer may manually and/or automatically solder and/or connect conductors in the power cable to conductors in the right-angle power plug. Upon completion of this soldering and/or connection process, the power cable may be able to carry electrical power through the right-angle power plug to a computing device, thereby feeding electrical power to the computing device.

While the foregoing disclosure sets forth various embodiments using specific illustrations, flowcharts, and examples, each illustration component, flowchart step, operation, and/or component described and/or exemplified herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. An apparatus comprising:

a right-angle power plug that:

plugs into a computing device; and facilitates feeding electrical power to the computing device when plugged into the computing device;

at least one power cable that is electrically coupled to the right-angle power plug at a right angle such that the power cable runs perpendicular to the right-angle power plug; and wherein the right-angle power plug includes a body that:

houses an interface at which the power cable is electrically coupled to the right-angle power plug; and includes a cable management solution that:

facilitates holding, to the body of the right-angle power plug, at least one additional power cable that is electrically coupled to an additional power plug; and includes at least one groove that is fitted to hold the additional power cable that is electrically coupled to the additional power plug; and includes at least one hole that:

is fitted to accept at least one retention screw that secures the right-angle power plug to the computing device; and intersects with the groove of the cable management solution such that the retention screw, when fully tightened to secure the right-angle power plug to the computing device, is recessed into the groove.

2. The apparatus of claim 1, wherein the right-angle power plug comprises a connector that mates with a connector of the computing device when the right-angle power plug is plugged into the computing device.

3. The apparatus of claim 1, wherein the body of the right-angle power plug has a maximum depth of 1.5 inches.

4. The apparatus of claim 3, wherein the cable management solution enables the body of the right-angle power plug to contain the additional power cable such that a circumference of the additional power cable does not extend beyond a depth dimension of the body of the right-angle power plug.

5. The apparatus of claim 4, wherein:

the power cable comprises a plurality of power cables that are electrically coupled to the right-angle power plug at right angles such that the power cables run perpendicular to the body of the right-angle power plug;

the additional power cable comprises a plurality of additional power cables that are electrically coupled to the additional power plug; and the groove comprises a plurality of grooves that are fitted to hold the additional power cables that are electrically coupled to the additional power plug.

6. The apparatus of claim 5, wherein the grooves:

are arranged on opposite sides of the body of the right-angle power plug; and each run in a direction that is parallel to the power cables.

7. The apparatus of claim 1, wherein the power cable is also electrically coupled to a power supply that provides electrical power to the right-angle power plug for feeding to the computing device.

8. A right-angle power plug comprising:

a connector that mates with a connector of a computing device;

at least one power cable that:

is electrically coupled to the connector of the right-angle power plug; and carries electrical power to the computing device through the connector of the right-angle power plug; and a body that:

houses an interface at which the power cable is electrically coupled to the connector of the right-angle power plug, wherein the body and the power cable form a right angle such that the power cable runs perpendicular to the body;

includes a cable management solution that:

facilitates holding, to the body of the right-angle power plug, at least one additional power cable that is electrically coupled to an additional power plug; and includes at least one groove that is fitted to hold the additional power cable that is electrically coupled to the additional power plug; and includes at least one hole that:

is fitted to accept at least one retention screw that secures the right-angle power plug to the computing device; and intersects with the groove of the cable management solution such that the retention screw, when fully tightened to secure the right-angle power plug to the computing device, is recessed into the groove.

9. The right-angle power plug of claim 8, wherein the body of the right-angle power plug has a maximum depth of 1.5 inches.

10. The right-angle power plug of claim 8, wherein the cable management solution enables the body of the right-angle power plug to contain the additional power cable such that a circumference of the additional power cable does not extend beyond a depth dimension of the body of the right-angle power plug.

11. The right-angle power plug of claim 10, wherein:

the power cable comprises a plurality of power cables that are electrically coupled to the right-angle power plug at right angles such that the power cables run perpendicular to the body of the right-angle power plug;

the additional power cable comprises a plurality of additional power cables that are electrically coupled to the additional power plug; and the groove comprises a plurality of grooves that are fitted to hold the additional power cables that are electrically coupled to the additional power plug.

12. The right-angle power plug of claim 11, wherein the grooves:

are arranged on opposite sides of the body of the right-angle power plug; and each run in a direction that is parallel to the power cables.

13. A method comprising:

forming a right-angle power plug that:

plugs into a computing device; and facilitates feeding electrical power to the computing device when plugged into the computing device; and electrically coupling a power cable to the right-angle power plug at a right angle such that the power cable runs perpendicular to the right-angle power plug, wherein the right-angle power plug includes a body that:

houses an interface at which the power cable is electrically coupled to the right-angle power plug; and includes a cable management solution that:

facilitates holding, to the body of the right-angle power plug, at least one additional power cable that is electrically coupled to an additional power plug; and includes at least one groove that is fitted to hold the additional power cable that is electrically coupled to the additional power plug; and includes at least one hole that:

is fitted to accept at least one retention screw that secures the right-angle power plug to the computing device; and intersects with the groove of the cable management solution such that the retention screw, when fully tightened to secure the right-angle power plug to the computing device, is recessed into the groove.

* * * * *